United States Patent [19]

Ikegami et al.

[11] 4,015,785

[45] Apr. 5, 1977

[54] METHOD AND APPARATUS FOR TREATING THE TERMINAL OF A WIRE-LIKE OBJECT IN A WIRE-LIKE OBJECT TAKE-UP APPARATUS

[75] Inventors: Yoshio Ikegami, Miki; Hirohumi Kimura; Tadashi Kohge, both of Kobe, all of Japan

[73] Assignee: Kobe Steel Ltd., Kobe, Japan

[22] Filed: Oct. 6, 1975

[21] Appl. No.: 620,017

[30] Foreign Application Priority Data

| | | |
|---|---|---|
| Oct. 4, 1974 | Japan | 49-114863 |
| Apr. 12, 1975 | Japan | 50-44404 |
| May 16, 1975 | Japan | 50-58959 |

[52] U.S. Cl. ..... 242/25 A

[51] Int. Cl.[2] ..... B65H 67/04

[58] Field of Search ..... 242/18 A, 25 A

[56] References Cited

UNITED STATES PATENTS

| | | | |
|---|---|---|---|
| 3,182,921 | 5/1965 | Nelson | 242/25 A |
| 3,621,190 | 11/1971 | Morikawa et al. | 242/25 A X |
| 3,661,335 | 5/1972 | Stefaniszyn | 242/25 A |
| 3,693,898 | 9/1972 | Otani | 242/25 A |
| 3,913,858 | 10/1975 | Ikegami | 242/25 A |

*Primary Examiner*—John Petrakes

*Attorney, Agent, or Firm*—Oblon, Fisher, Spivak, McClelland & Maier

[57] ABSTRACT

A method and apparatus for treating the terminal end portion of a wire-like object within a wire-like object take-up apparatus is disclosed as including main and auxiliary terminal treating covers, the covers being moved axially toward each other and in surrounding relation with respect to a bobbin upon which the wire-like object is wound so as to define therebetween an overlapped position within which a terminal end receiving chamber or spacing is defined. In this manner, the terminal end is encased and upon severance of the same, the terminal end cannot fly about in a random manner, or be additionally severed and shredded, whereby damage thereto, as well as to the take-up apparatus and wound object, and the operating personnel, is effectively prevented.

15 Claims, 25 Drawing Figures

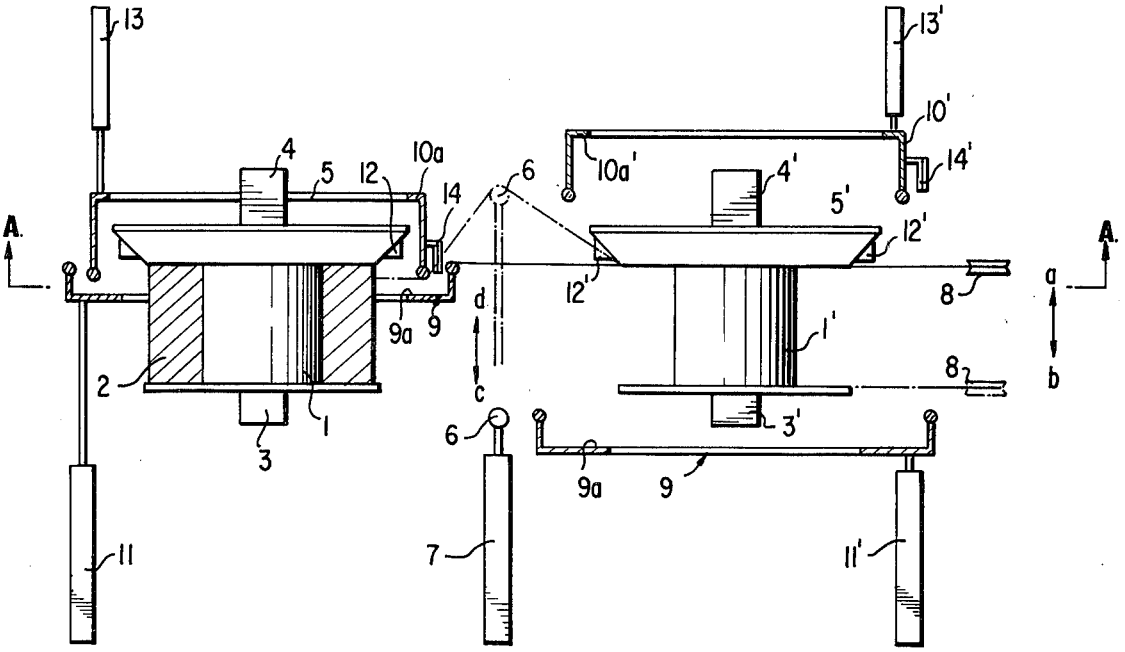
FIG. 1
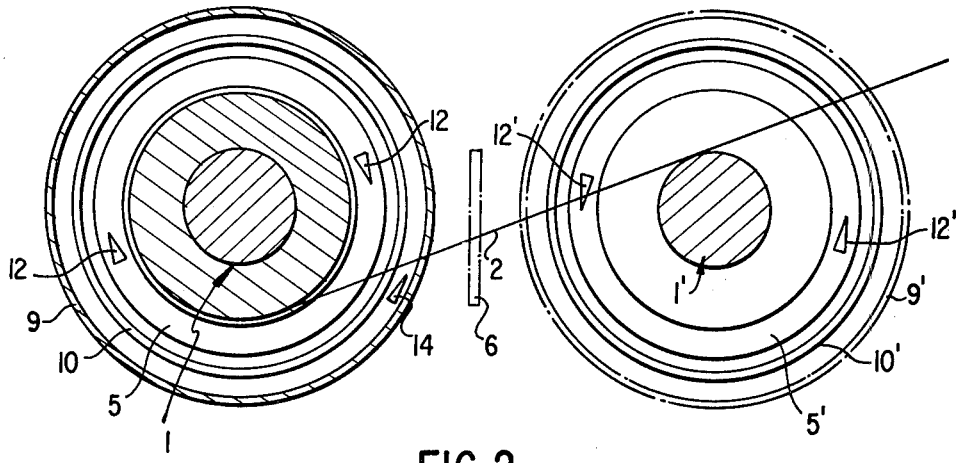
FIG. 2
FIG. 3
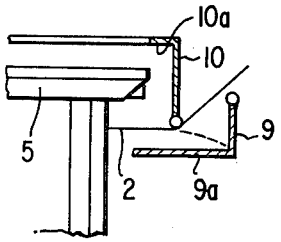

FIG.4
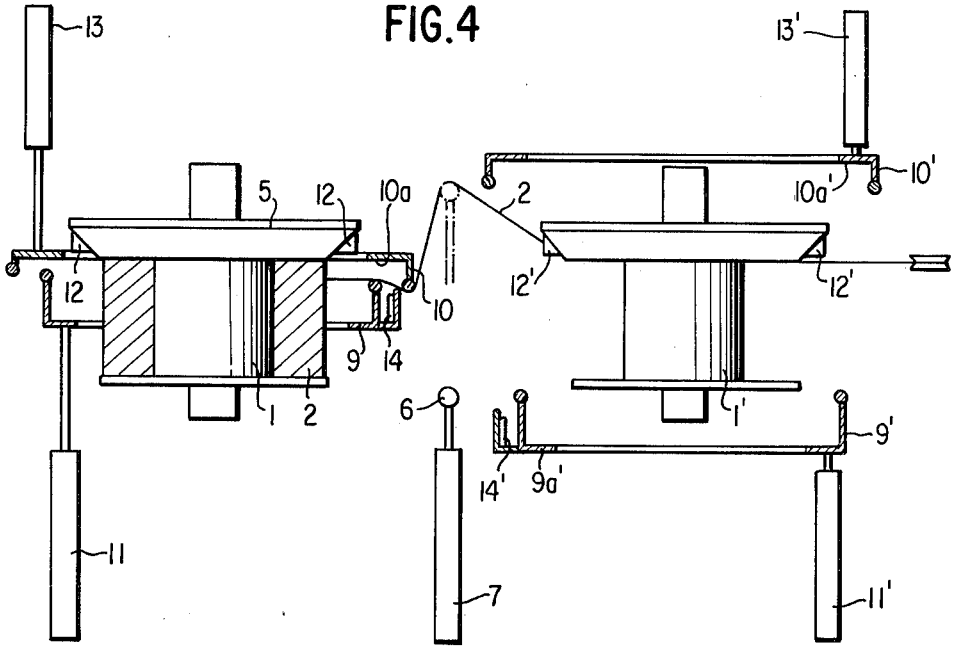
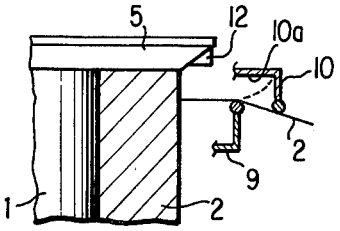
FIG.5
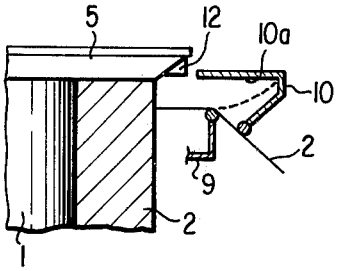
FIG.6
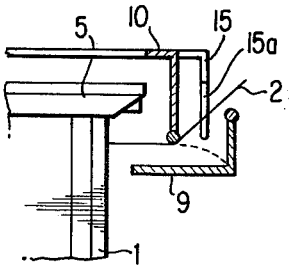
FIG.11
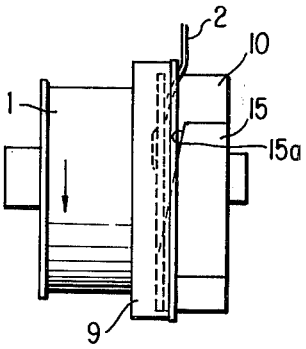
FIG.12

FIG. 19
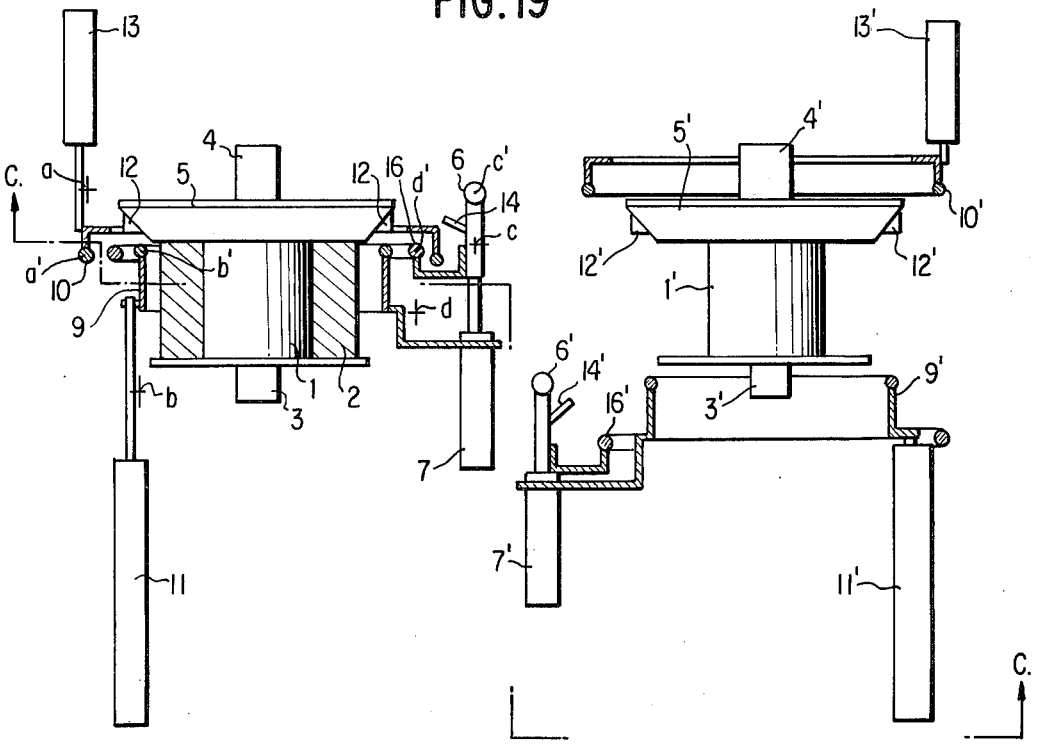
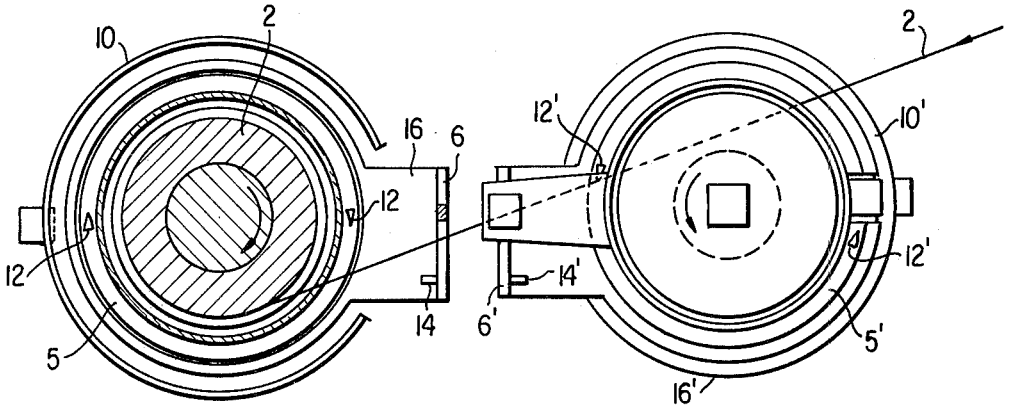
FIG. 20

METHOD AND APPARATUS FOR TREATING THE TERMINAL OF A WIRE-LIKE OBJECT IN A WIRE-LIKE OBJECT TAKE-UP APPARATUS

BACKGROUND OF THE INVENTION

1. Field of the Invention

The present invention relates generally to wire take-up methods and apparatus, and more particularly to a method and apparatus for effectively treating the terminal end portion of the wire.

2. Description of the Prior Art

Within wire-like object take-up apparatus for performing the take-up operation of various kinds of wire-like objects, such as, for example, cables, it has been a common practice to move the wire-like object between a full bobbin and an empty bobbin, which are disposed in parallel relation with respect to each other, and toward a pawl disposed upon the empty bobbin by which the wire-like object is caught and severed in order to automatically initiate the take-up operation of the wire-like object upon the empty bobbin. In this instance, the severed terminal end portion is subjected to the potential energy stored within the wire-liek object and undergoes a spring-back movement, and is likewise subjected to the centrifugal forces acting thereon whereby a pulling action is instantaneously exerted upon the terminal end portion which tends to damage the wire-like object, and the terminal end portion thereof, disposed upon the full bobbin. Furthermore, the severed terminal end portion of the wire-like object is freely movable until the rotation of the full bobin is terminated and consequently, the terminal end portion strikes against the wire-like object disposed upon the full bobbin thereby causing damage to the same. Still further, the terminal portion of the wire-like object is likely to become entangled with the rotating pawls, as a result of which the winding efficiency and yield rate of the product are considerably decreased and under such entangled conditions, the severed terminal tends to be shredded into pieces which fly off in a random manner thereby causing further damage to the apparatus, as well as creating dangerous conditions.

In order to solve these problems, it has heretofore been proposed to provide various expedients, such as, for example, a cylindrical cover formed with a slit for passage therethrough of the wire-like object and so configured as to conceal the full bobbin in its entirety; a circular ring adapted to push th wire-like object toward one side of the bobbin; and another type of circular ring provided upon one side of the bobbin and including an annular recess and a projection serving as a guide for the wire-like object.

Among these expedients, however, the cylindrical cover is disadvantageous in that the terminal end of the wire-like object flies out of the cylindrical cover through means of the slit formed therein until the rotation of the full bobbin is terminated and in this situation, a portion of the terminal end is shredded into pieces due to its striking against the slit, which pieces are of course dangerous as noted heretofore.

Within the apparatus within which the circular ring is utilized for pushing the wire-like object toward the one side of the bobbin, the terminal portion of the wire-like object escapes from the circular ring and tends to become entangled with the pawl of the bobbin, and therefore, the self-cleaning operation of the pawl cannot be performed. Consequently, the automatic take-up operation cannot be initiated, and thus, the take-up efficiency is considerably decreased.

In the case wherein the circular ring having an annular recess or projection is utilized, similar problems regarding the self-cleaning of the pawl will be presented, and in addition, the wire-like object tends to be severed by means of the projection during high speed rotation of the bobbin. Thus, the prior art expedients cannot satisfactorily solve the various problems noted hereinabove.

SUMMARY OF THE INVENTION

The present invention contemplates to solve the above-mentioned problems encountered within the prior art and has its principal object of providing a method and apparatus within which covers are moved toward each other in a simple fashion until the covers overlap each other, and under such overlapped conditions, the terminal end portion of the wire-like object is suitably led into the spacing defined between the covers whereupon the terminal is smoothly guided therein without causing damage to the wire-like object disposed upon the full bobbin.

The present invention thus features the provision of a wire-like object terminal treating method within a wire-like object take-up apparatus within which the terminal end of the wire-like object disposed upon the full bobbin is led into and guided with a terminal accommodating spacing defined by cover means during the course of moving the wire-like object, wound upon the full bobbin, toward the empty bobbin, grasping the wire-like object, and cutting the same for performing the automatic and alternate take-up operation of the wire-like object.

More specifically, a main terminal treating cover and an auxiliary terminal treating cover, which are both cylindrical in shape, are moved toward each other along the outer periphery of the full bobbin and relative to the wire-like object being fed onto the full bobbin, and the same overlap each other before the terminal end of the wire-like object passes therebetween. In this condition, the terminal end of the wire-like object is led by means of the overlapped portion of the covers into the terminal accommodating spacing defined by means of the covers whereby the terminal is accommodated within the spacing due to the centrifugal forces acting thereon during rotation of the bobbin.

In order to treat the terminal end of the wire-like object in a more reliable manner at a higher rate of speed of rotation in accordance with the method of the present invention, the present invention also encompasses the following additional features. In accordance with a first aspect of the present invention, a main terminal treating cover is moved or advanced while leaving a thrust gap defined between the leading end of the main terminal treating cover and a flange of the take-up bobbin pawl wheel so as to permit travelling of the wire-like object, yet thereby completely preventing the wire-like object upon the full bobbin from being damaged by means of the terminal end thereof striking thereagainst.

In accordance with another aspect of the present invention, a guide is provided upon one or both of the main and auxiliary terminal treating covers for quickly leading the terminal end portion into the terminal end accommodating spacing in more reliable manner, and in accordance with still another aspect of the present invention, a sloped portion is provided upon one or both of the outer peripheral walls of the main and auxiliary terminal treating covers. In accordance with a further aspect of the present invention, a ring is attached to a wire-pushing actuator, and in accordance with a still further aspect of the present invention, the wire-pushing actuator and an actuating cylinder therefor are attached to the main terminal treating cover for thereby treating the wire-like object terminal in a highly reliable manner within the shortest period of time. In order to achieve the foregoing, a severing cutter is provided upon the outer peripheral wall of the auxiliary terminal treating cover or upon the wire-pushing acutator.

In accordance with a still yet further aspect of the present invention, a guide means, made of suitable shock absorbing material, is provided along the travelling path of the wire-like object terminal so as to completely prevent the wire-like object from being damaged by means of the terminal end portion thereof due to the potential energy spring-back movement thereof. In accordance with a still further aspect of the present invention, a safety cover is provided for preventing damage to the apparatus which may be caused as a result of the randomly dispersed flying action of pieces of the severed terminal end even if a portion of the wire-like object terminal end should nevertheless be shredded.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG. 1 is a schematic view, partly in cross section, of a first embodiment of an apparatus, for carrying out a method of the present invention, in accordance with the present invention and showing its cooperative parts;

FIG. 2 is a cross-sectional view of the apparatus of FIG. 1 taken along the line A—A of FIG. 1;

FIG. 3 is a fragmentary enlarged view of a part of the apparatus shown within FIG. 1;

FIG. 4 is a schematic view, partly in cross section, of a second embodiment of the apparatus constructed in accordance with the present invention;

FIG. 5 is a fragmentary enlarged sectional view of a part of the apparatus shown within FIG. 4;

FIG. 6 is a view similar to that of FIG. 5, showing however a modified form fo the part shown within FIG. 5;

FIGS. 11 and 12 are fragmentary enlarged views of parts of the apparatus shown within FIG. 10;

FIG. 19 is a schematic view, partly in cross section, of a seventh embodiment of the apparatus constructed in accordance with the present invention;

FIG. 20 is a cross sectional view of the apparatus of FIG. 19 taken along the line C—C of FIG. 19;

DETAILED DESCRIPTION OF THE ILLUSTRATED EMBODIMENTS

Figure 7:
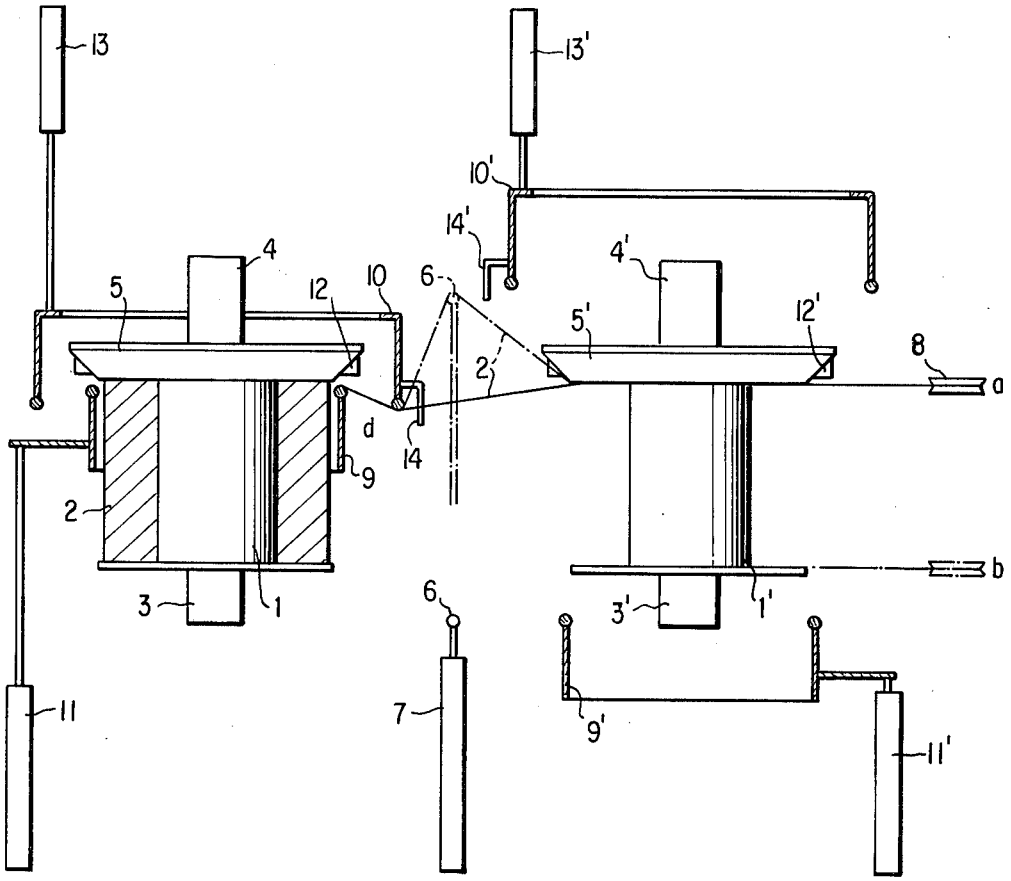
FIG. 7 is a schematic view, partly in cross section, of a third embodiment of the apparatus constructed in accordance with the present invention.

A method and an apparatus developed and constructed in accordance with the present invention will now be described hereinafter with reference to the drawings, wherein a first embodiment thereof is illustrated within FIGS. 1–3. Bobbins 1 and 1′ are provided for an operative relationship with a wire-like object 2, drive shafts 3 and 4, and 3′ and 4′ rotatably supporting the bobbins, respectively. Pawl wheels 5 and 5′ are respectively provided upon the outer peripheries of the bobbins and have engaging pawls 12 and 12′, respectively, fixedly secured thereon. A wire-pushing piston-type actuator 6 engageable with the wire-like object and movable forwardly or rearwardly by means of a cylinder 7 serves as an actuating means, and a traverser guide sheave 8 is also provided for initiating the uniform take-up of the wire-like object upon the bobbins.

The bobbins 1 and 1′, which are disposed in parallel with respect to each other, are rotated in opposite directions, and the wire-like object 2, which is engageable with the guide sheave 8 which is movable between the position shown in phantom lines and the position shown in solid lines relative to both of the bobbins 1 and 1′, is fully wound upon the bobbin 1, FIG. 1 showing the condition wherein the bobbin 1 is fully wound with the wire-like object 2 thereon, and, therefore, bobbin 1 will hereinafter be referred to as the full bobbin. The sheave 8 is moved forwardly or rearwardly between the points *a* and *b* as shown within FIG. 1, and thereafter, the sheave assumes the position of point *a* so that the take-up operation of the wire-like object 2 upon the bobbin 1′ can be accomplished.

This take-up operation is performed by pushing the wire-like object 2 toward the outer peripheral wall of the bobbin 1′, which will hereinafter be referred to as an empty bobbin, engaging the wire-like object 2 with the pawls 12′ of the pawl wheel 5′, as shown within FIG. 2, and cutting the wire-like object 2 at a suitable position, and under these conditions, the terminal end of the wire-like object 2 wound upon the full bobbin 1 is brandished at the outer periphery of the full bobbin 1 thereby presenting various problems as previously mentioned. Within the first embodiment, a main terminal treating cover 9 or 9', and an auxiliary terminal treating cover 10 or 10', are also separately provided and movable toward and away from each other so as to induce and guide the terminal end of the wire-like object 2 by means of the facing peripheries thereof.

More specifically, the main terminal treating cover 9 or 9' is supported by means of a cylinder 11 or 11', serving as actuating means therefor at one side of the bobbin 1 or 1', respectively, and the cylinders 11 or 11' are movable between the points *c* and *d* as seen within FIG. 1. The main terminal treating cover 9 or 9' is formed so as to have a cylindrical configuration which is larger in diameter than the pawl wheel 5 or 5', and has a radially extending wall 9*a* or 9*a*' facing the pawl wheels, respectively. The main terminal treating cover 9 or 9' is movable into the vicinity of the pawl wheel 5 or 5', and the auxiliary terminal treating cover 10 or 10' is similarly disposed in an opposed relationship with respect to the main terminal treating cover 9 or 9', upon the opposite side or wheels 5 or 5'.

The auxiliary terminal treating cover 10 or 10' has a diameter which is different than that of the main terminal treating cover 9 or 9', and, within the first illustrated embodiment, the auxiliary terminal treating cover is formed so as to be smaller in diameter than the main terminal treating cover. Likewise, the auxiliary terminal treating cover 10 or 10' is provided with a radially extending wall 10*a* or 10*a*', and is movable across the outer peripheries of the wheels 5 and 5', in overlapping or surrounding relationship, by means of cylinders 13 and 13' serving as actuating means therefor whereby the forward or leading ends of the main terminal treating cover 9 or 9' and the auxiliary terminal treating cover 10 or 10' overlap each other as shown within FIG. 3. Cutters 14 and 14' are mounted, at suitable circumferential positions, upon the ouer peripheries of the auxiliary terminal treating cover 10 or 10'.

Within the second preferred embodiment, the main terminal treating cover 9 or 9' is formed so as to be smaller in diameter than the auxiliary terminal treating cover 10 or 10' as shown within FIGS. 4 and 5, and the cutter 14 or 14' is mounted upon the main terminal treating cover 9 or 9', respectively. FIG. 6 also shows a further modification within which the auxiliary terminal treating cover 10 or 10' is configured so as to have an interior annular recess portion.

A method of operation of the present invention to be carried out by means of the apparatus of the first and second preferred embodiments will now be described. During the take-up operation, the guide sheave 8 is located at the position *a* shown within FIG. 1, and upon completion of the take-up operation upon bobbin 1, the take-up operation upon a new bobbin is commenced.

More particularly, when the wire-like object 2 is disposed within the tangential position shown within FIG. 2, the main terminal treating cover 9 and the auxiliary terminal treating cover 10 are moved toward each other. Consequently, the covers 9 and 10 overlap each other, as shown within FIGS. 1 and 3, and therefore, the wire-like object 2 is biased and guided by means of both covers 9 and 10. Under these circumstances, the wire-pushing actuator 6 is moved to its operative position, shown by phantom lines within FIGS. 1 and 2, so that the wire-like object 2 is grasped by means of the pawls 12' of the empty bobbin, and the terminal end of the wire-like object upon the full bobbin is severed by means of the cutter 14 of the full bobbin system.

The terminal end of the wire-like object 2 thus severed is caused to engage the walls 9*a* and 10*a* in a manner shown, for example, within FIGS. 3, 5 and 6, and is subsequently guided within a terminal accommodating space defined by means of the covers 9 and 10, and by the guide surfaces thereof, whereby the movement of the terminal end of the wire-like object is terminated without being damaged. In addition, as the travelling path of the wire-like object 2 is regulated by means of the covers 9 and 10 in such a manner that the wire-like object is spaced from the pawls 12 of the full bobbin 1, the wire-like object 2 is effectively prevented from becoming interlaced or entangled with such structure. Still further, as the opening for leading the wire-like object 2 outwardly or exteriorly of the bobbin 1 is not maintained in the opened condition at all times, and in addition, as the opening defined by means of the covers 9 and 10 does not oppose the wire-like object 2 and impart resistance thereto, the wire-like object is prevented from being partially cut whereby such cut particles would normally scatter outwardly inflicting additional damage to the apparatus.

It should be noted that if the perpheries of the main terminal treating cover 9 or 9' and the auxiliary terminal treating cover 10 or 10' are maintained in an overlapped condition, even to a slight degree, the same result will be obtained, and, therefore, each of the covers may be formed so as to have any desired geometrical configuration, such as, for example, a stepped or arcuate configuration in cross-section. It should be noted further that the amount of overlapping of the covers has no effect upon the final result, however the overlapping of the covers should be provided to the degree which is sufficient for preventing the terminal end of the wire-like object 2 to exit from the aforenoted space defined by the covers.

Figure 8:
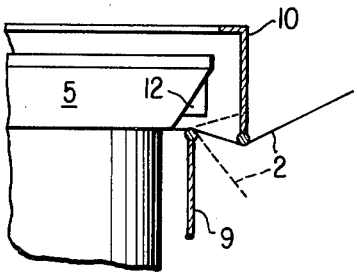
FIG. 8 is a fragmentary enlarged view of a part of the apparatus shown within FIG. 7.
Figure 9:
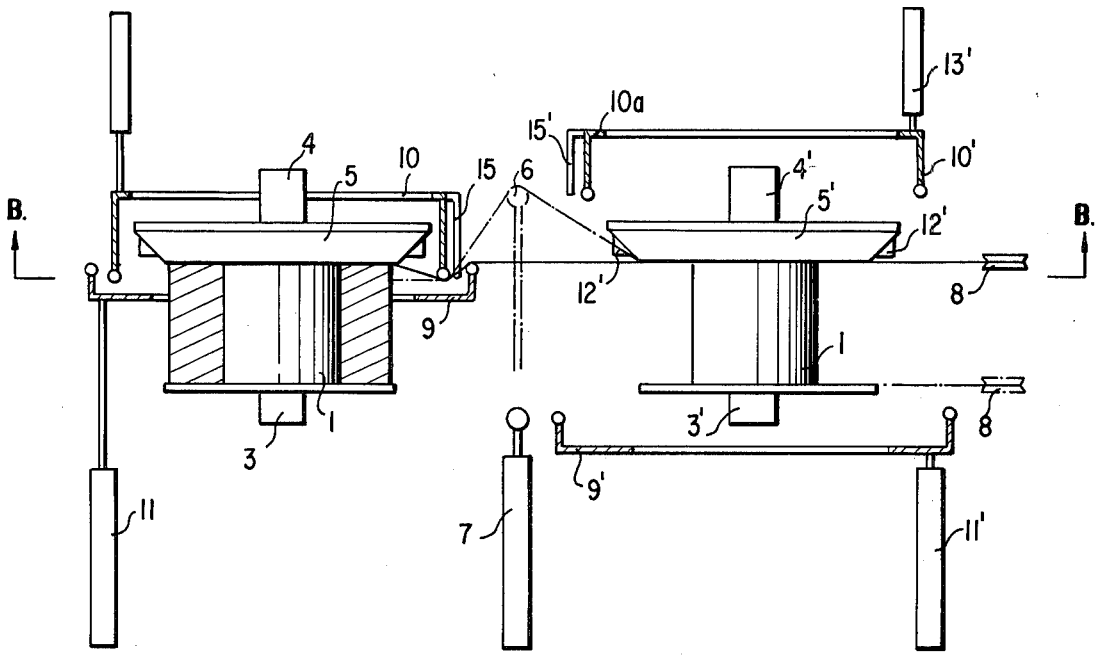
FIG. 9 is a schematic view, partly in cross section, of a fourth embodiment of the apparatus constructed in accordance with the present invention.

Referring now to FIGS. 7 and 8, a third embodiment of the present invention is illustrated wherein the take-up bobbins 1 and 1', the wire-like object 2, the drive shafts 3 and 4, and 3' and 4', the pawl wheels 5 and 5', provided upon their peripheries with pawls 12 and 12', respectively, for grasping the wire-like object, the wire-pushing piston actuator 6, engageable with the wire-like object and movable forwardly or rearwardly by means of the cylinder 7, and the traverser guide sheave 8 are disposed in a manner similar to that of the embodiments of FIGS. 1–6. Within the presently illustrated embodiment, the apparatus is arranged such that the severed terminal end of the wire-like object is radially spaced from the periphery of the full bobbin 1 in a reliable manner under the condition wherein the main terminal treating cover and the auxiliary terminal treating cover overlap each other and the terminal end of the wire-like object is smoothly accommodated within the area defined between the covers without being damaged, and consequently the severed end of the wire-like object can be retained upon the full bobbin in the most suitable condition. As shown within FIGS. 7 and 8, the essential feature of this embodiment resides in the fact that the main terminal treating cover 9 or 9' is arranged to be movable towardd the side walls of the pawl wheels 5 or 5' and to a predetermined point so as to provide a predetermined gap or space which will permit the travelling of the wire-like object 2 therewithin.

In accordance with the third embodiment of the present invention, it is possible to treat the severed terminal end of the wire-like object in a highly efficient and reliable manner. As the main terminal treating cover 9 or 9′ is caused to approach the side wall of the pawl wheel in order to define the predetermined gap and thereby permit the aforenoted travel mode of the wire-like object to occur, it is possible to prevent the occurrence of adverse repercussions of the terminal end of the wire-like object that would in fact otherwise occur due to unnatural or uncontrolled movement of the same and to also prevent the wire-like object disposed upon the full bobbin from being adversely affected by means of the wire-like object to be wound upon the empty bobbin even when a failure occurs in engaging the wire-like object with the pawl 12′ of the empty bobbin 1′ by means of the biasing action of the actuator 6.

That is, when a failure occurs in grasping the wire-like object, the covers effectively serve as safety covers in order to prevent the wire-like object upon the full bobbin from flying outwardly toward the circumference of the bobbin when the full bobbin is rotated at a high rate of speed. In addition, the auxiliary terminal treating cover 10 or 10′, and more particularly the inner peripheries thereof, serve to guide the terminal end of the wire-like object in a reliable manner in order to prevent lashing thereof. In this manner, the terminal treating covers serve as means to guide the terminal end of the wire-like object until the rotation of the bobbin is terminated, and, at the same time, serve as safety covers during the shifting or transfer operation. Moreover, the covers are highly effective in preventing the wire-like object from being grasped by the pawls of the full bobbin whereby the shifting or transfer operation can in fact be smoothly performed.

With reference now being made to FIGS. 9–12, an embodiment of the present invention will be decribed, wherein the apparatus of such embodiment is so arranged as to have a resisting guide adapted to prevent the occurrence of any adverse repercussions from the terminal end of the wire-like object due to centrifugal forces acting thereon and to more smoothly permit the take-up of the terminal end of the wire-like object in a safe manner through means of a predetermined travel path.

Figure 10:
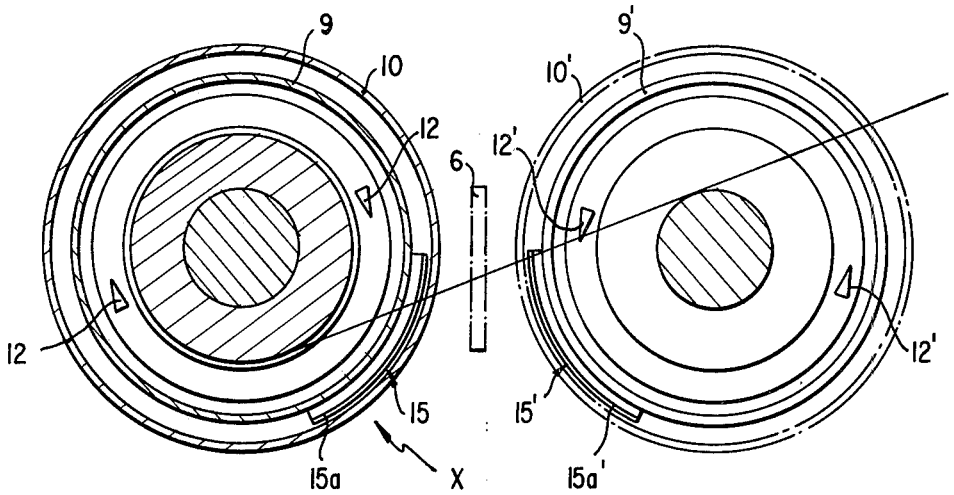
FIG. 10 is a cross-sectional view of the apparatus of FIG. 9 taken along the line B—B of FIG. 9.

More particularly, leading guides 15 and 15′, having guide surfaces 15*a* and 15*a*′, respectively, are interposed between an overlapped portion of the main terminal treating cover 9 or 9′ and the auxiliary terminal treating cover 10 or 10′ at the axially projecting free ends thereof, and as seen within FIG. 10, the leading guides 15 or 15′ are formed with an arcuate configuration in cross-section, the center of which coincide with the central axes of the bobbins, and are mounted upon and extend along a portion of the outer periphery of the cover 10 or 10′. The leading guides 15 or 15′ are formed with slanted guide surfaces 15*a* or 15*a*′ such that when the bobbin 1 or 1′ is rotated, the terminal end of the wire-like object 2 is forcibly urged toward the cover 9 or 9′ having the larger diameter whereby repercussions produced by means of the terminal end of the wire-like object are reduced to a minimum degree, and therefore, damage to the terminal end of the wire-like object 2, as well as to the covers 9 and 9′, and 10 and 10′, is satisfactorily eliminated while the wire-like object disposed upon the full bobbin is also prevented from being damaged as a result of any repercussions of the terminal end thereof.

Figure 13:
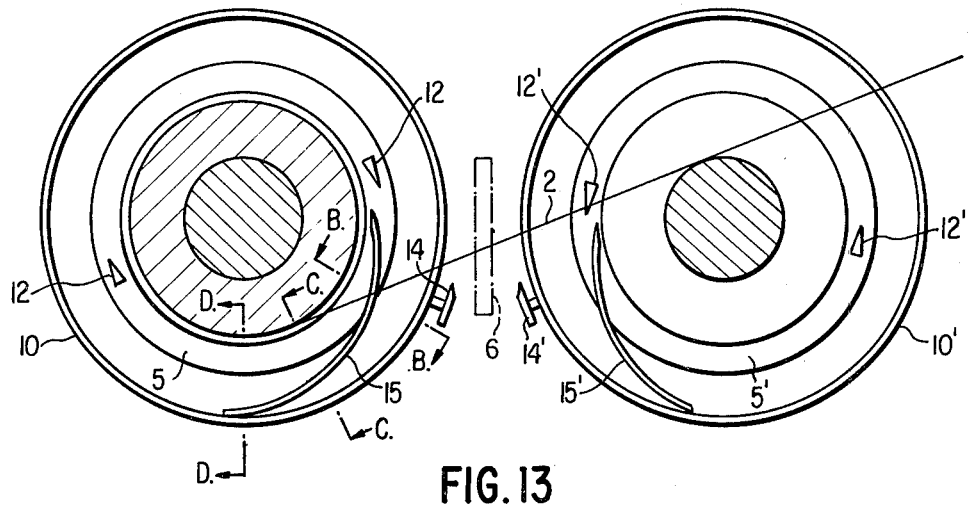
FIG. 13 is a schematic view, partly in cross section, of a fifth embodiment of the apparatus constructed in accordance with the present invention.

Turning now to FIGS. 13–16, a fifth embodiment of the present invention is illustrated whereby such an embodiment is different from the fourth embodiment in that the arcuate guides do not have slanted guide surfaces and, in lieu thereof, the centers of the arcuate guides are eccentrically disposed with respect to the central axes of the bobbins as clearly disclosed within FIG. 13.

More particularly, the guides 15 or 15′ are identical to those of the fourth embodiment in that the guides 15 or 15′ are interposed between an overlapped portion of the covers 9 and 10 or covers 9′ and 10′, however, within this fifth embodiment, the guide 15 or 15′ is mounted in such a manner that one end of the guide assumes a radially inward position while the other end of the guide assumes a radially outward position whereby the terminal end of the wire-like object is forcibly biased toward the cover 10 or 10′ having a larger diameter than that of cover 9 or 9′. As shown within FIGS. 14–16, each of the guides 15 and 15′ is also formed to have a width less than that of the peripheral portion of the cover 9 or 9′.

Figure 14:
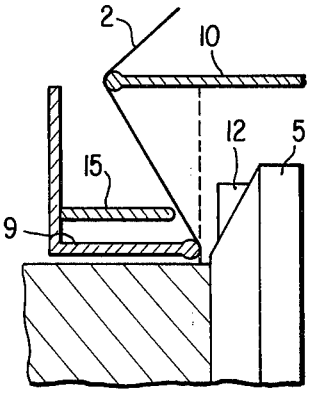
FIGS. 14-16 are fragmentary enlarged cross-sectional views of parts of the apparatus shown within FIG. 13, taken along line B—B, C—C, and D—D, respectively.

The relationship between the guides 15 or 15′ and the terminal end of the wire-like object 2 will now be explained in detail with reference to FIGS. 14–16, FIGS. 14, 15 and 16 being partial cross-sectional views taken along the lines B—B, C—C, and D—D, respectively, of FIG. 13. The severed terminal end of the wire-like object 2 is rotated in accordance with the rotation of bobbin 1, and within the position shown within FIG. 14, the guide has no effect upon the terminal end portion.

Figure 15:
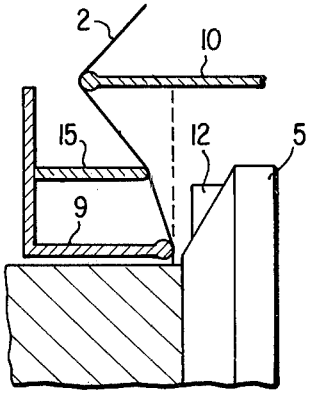
Figure 16:
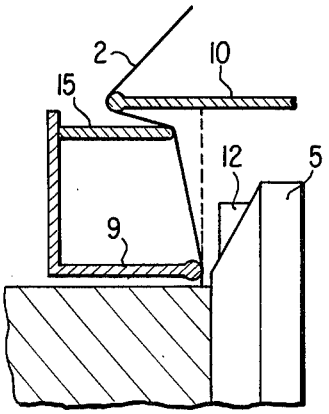

However, as the bobbin 1 is rotated to the relative position shown within FIG. 15, the guide 15 engages the wire-like object 2, and thus, the wire-like object 2 is biased to a slight extent toward the wheel 5 whereby frictional forces are produced between the wire-like object 2 and the covers 9 and 10 as well as between the wire-like object 2 and the guide 15. As the bobbin 1 is further rotated to the relative position shown within FIG. 16, the wire-like object 2 is further biased and tensioned, and, therefore, the frictional forces increase whereby the terminal end portion of the wire-like object 2 is led into the spacing defined by means of the covers.

Figure 17:
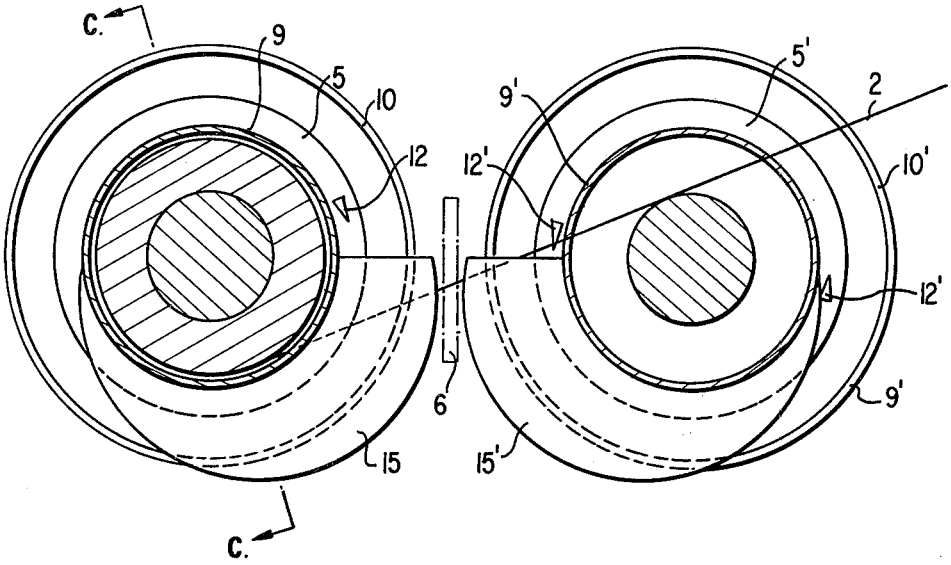
FIG. 17 is a schematic view, partly in cross section, of a sixth embodiment of the apparatus constructed in accordance with the present invention.
Figure 18:
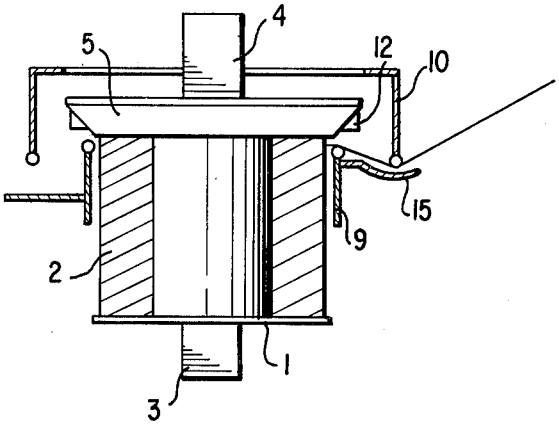
FIG. 18 is a cross-sectional view of the apparatus of FIG. 17 taken along the line C—C of FIG. 17.
Figure 23:
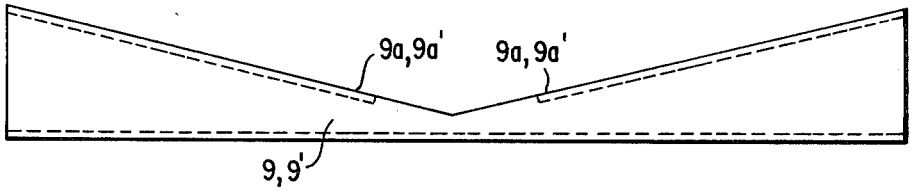
FIG. 23 is an exploded plan view of a part of the apparatus shown within FIG. 21.
Figure 21:
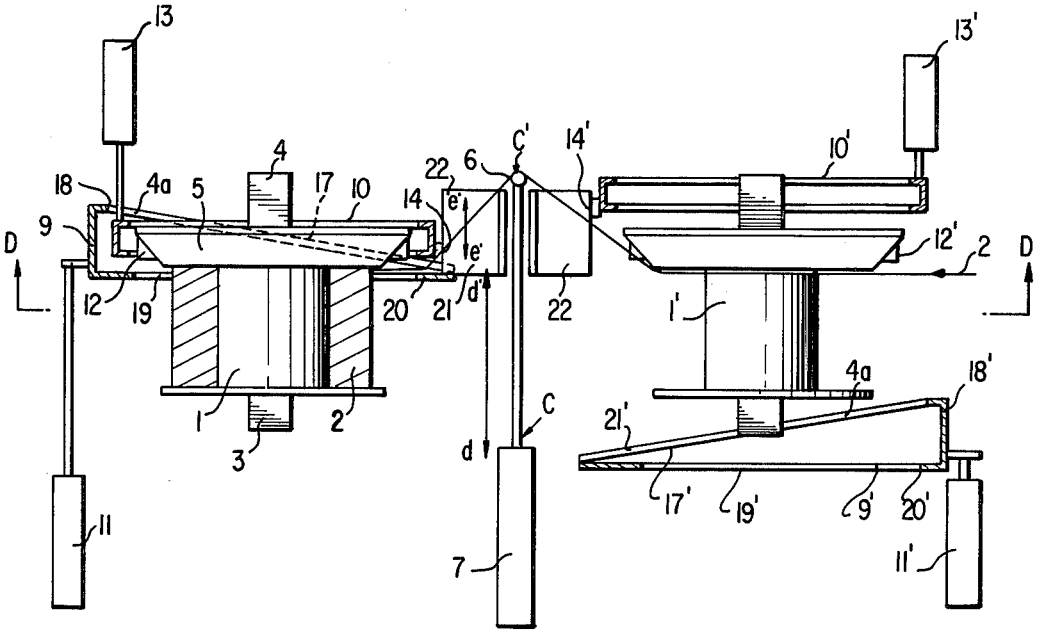
FIG. 21 is a schematic view, partly in cross section, of an eighth embodiment of the apparatus constructed in accordance with the present invention.
Figure 22:
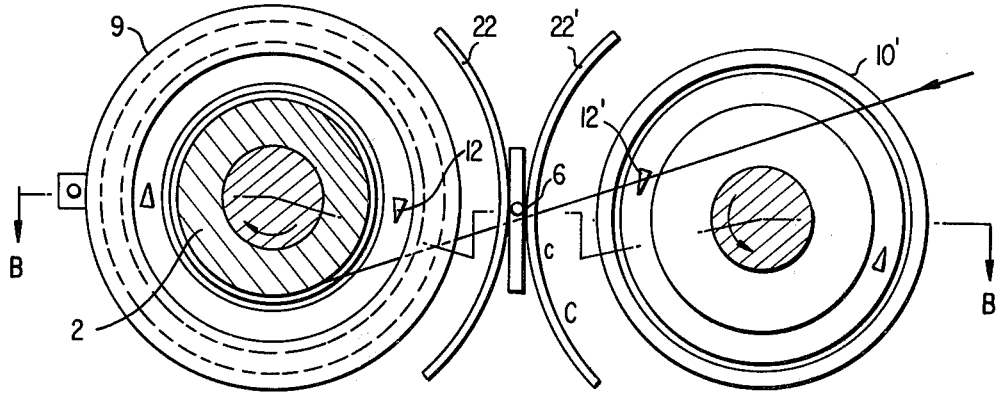
FIG. 22 is a cross sectional view of the apparatus of FIG. 21 taken along the line D—D of FIG. 21.
Figure 24:
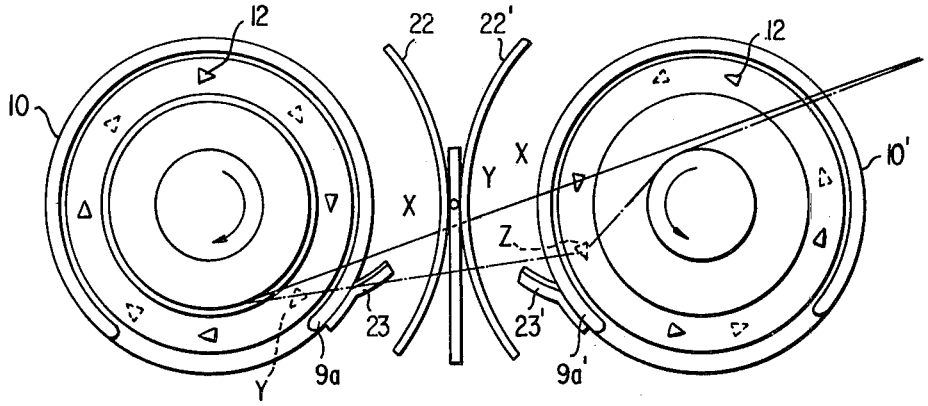
FIG. 24 is a view similar to that of FIG. 22, showing however a modified form of the apparatus shown within FIG. 21.

Reference will now be made to FIGS. 17 and 18 wherein a sixth embodiment of the present invention is disclosed, and within this sixth embodiment, the guide 15 is formed so as to have an arcuate configuration and is additionally provided with a U-shaped portion in cross-section as shown within FIGS. 17 and 18. The guide 15 thus formed extends completely transversely across the terminal accommodating spacing, and has its center disposed eccentrically with respect to the central axis of the bobbin.

In operation, when the wire-biasing actuator 6 is moved toward the pawl wheel 5, the wire-like object 2 is severed by means of a cutter, not shown, and the terminal end portion thereof engages the U-shaped portion of the guide 15 whereby the terminal end portion is conducted into the spacing defined between the covers in the direction of rotation of the bobbin while also being guided by means of the U-shaped portion. In this manner, the guide 15 guides the terminal end portion of the wire-like object 2 such that the same is led into the spacing, defined between the covers, in a highly reliable manner, and as a result, the potential energy of the resilient spring-back portion of the terminal end portion is satisfactorily absorbed by means of the U-shaped portion of the guide 15. Preferably, the U-shaped portion may be modified in its configuration whereby an appropriate amount of frictional force is produced between the guide plate and the wire-like object so as to in fact reliably lead the same into the spacing defined between the covers.

Turning now to a seventh embodiment of the present invention as shown within FIGS. 19 and 20, a wire-pushing actuator 6 or 6′ is fixed to a biasing ring 16 or 16′, and a cylinder 7 or 7′, for actuating the actuator, is fixed to the main terminal treating cover 9 or 9′. With this arrangement, the main terminal treating cover 9 or 9′ and the auxiliary terminal treating cover 10 or 10′ are moved toward each other so as to define a spacing therebetween for accommodating the terminal end of the wire-like object, and the biasing ring 16 or 16′ is seen to be located upon the same side of the wheels 5 or 5′ as the main terminal treating cover 9 or 9′. Within this illustrated embodiment then, the cylinder 7 or 7′ is supported by means of the main terminal treating cover 9 or 9′, and the biasing ring 16 or 16′ is fixedly supported by means of the actuator 6 or 6′.

With this arrangement, the biasing ring 16 or 16′ is moved toward the auxiliary terminal treating cover when the main terminal treating cover 9 or 9′ is moved toward the same, and is further moved to its operative position when the actuator rod 6 or 6′ is moved by means of the operative movement of the cylinder 7 or 7′. The rod 6 or 6′ is arranged to be movable parallel to the axes of the bobbin 1 or 1′ and between the bobbins 1 and 1′, and is also provided with a cutter 14 or 14′ for cutting the wire-like object 2. It is to be noted that the biasing ring 16 or 16′ and the cutter 14 or 14′ may be formed to have any desired configuration other than those shown within FIG. 19, and that the mounting positions of the biasing rings and the cutters may be altered is dependence upon various operative requrements.

Within winding apparatus of the aforenoted conventional type, within which bobbins are nomrally disposed in parallel with respect to each other, the bobbins 1 and 1′ are rotated in opposite directions at different rates of speeds, such as, for example, the rotational speed of th empty bobbin 1′ may be twice that of the full bobbin 1. For this reason, the wire-like object 2 extending from teh full bobbin 1 toward the empty bobbin 1 is normally severed by means of the pawl 12′ of the empty bobbin 1′, and thus, the terminal end portion of the wire-like object 2 upon the full bobbin 1 is freely movable.

Within the illustrated embodiment, however, the biasing ring 16 or 16′ is moved toward its operative position whereby the terminal portion of the wire-like object is forcibly inserted into the spacing defined between the main terminal treating cover 9 or 9′ and the auxiliary terminal treating cover 10 or 10′, and in addition, the terminal portion extending between the auxiliary terminal treating cover 10 or 10′ and the actuator rod 6 is severed by means of the cutter 14 or 14′ whereby the length of the terminal portion of the wire-like object upon the full bobbin 1 is less than that normally characteristic of the prior art. Still further, the terminal portion of the wire-like object 2 is forcibly conducted, by means of the biasing ring 16 or 16′, into the spacing defined between the covers and is permitted to rotate therein. Thus, it is possible to avoid the formation of a relatively long terminal portion of the wire-like object 2 and to prevent the random movement of the severed terminal portion thereby preventing the wound wire-like object disposed upon the full bobbin 1 from being damaged by means of such free movement of the terminal portion, as well as preventing the terminal portion from being cut into additional pieces which can also fly about in a random fashion causing damage to the wound spool or other apparatus components.

Referring now to FIGS 21–24, an eighth embodiment of the present invention is illustrated therein, and within such embodiment, a sloped or inclined portion is formed upon the outer peripheral wall of either one or both of the main terminal treating cover 9 or 9′ and auxiliary terminal treating cover 10 or 10′. Within FIGS. 21 and 22, the bobbins 1 and 1′ are disposed in parallel relation with respect to each other and are rotatable in opposite directions by means of suitable driving mechanisms. The bobbins 1 or 1′ have at one end thereof the pawl wheel 5 or 5′ provided with one or more pawls 12 or 12′, and the wire-pushing actuator rod 6 is interposed between the bobbins 1 and 1′, and is arranged to be axially movable between the positions C and C′ by means of a suitable actuating device, such as, for example, air cylinder 7. The apparatus of this embodiment further includes, as is conventional, traverser means, now shown, adapted to move the wire-like object relative to the bobbin for thereby causing the wire-like object to be uniformly wound upon the bobbins and shifted therebetween.

The main terminal treating cover 9 or 9′ and the auxiliary terminal treating cover 10 or 10′ are movable between the positions *d* and *d′* and between the points *e* and *e′*, respectively, by actuating means, such as, for example, cylinders 11 and 11′ and cylinders 13 and 13′, respectively, whereby the main terminal treating cover 9 or 9′ and the auxiliary terminal treating cover 10 or 10′ overlap each other so as to define a spacing therebetween for treating the terminal end portion of the wire-like object. Within this illustrated embodiment, it is also apparent that the main terminal treating cover 9 or 9′ has a cylindrical or annular portion which is larger in diameter than the corresponding cylindrical or annular portion of the auxiliary terminal treating cover 10 or 10′, and the main terminal treating cover 9 or 9′ is also formed with a rib 18 or 18′ by which a sloped portion 9*a* or 9*a′*, inclined downwardly toward the actuator rod 6, is provided at a position so as to face the wheel 5 or 5′, as shown within the expansion plan view of FIG. 23.

The rib 18 or 18′ is formed with an opening 17 or 17′ through which the auxiliary terminal treating cover 10 or 10′ is freely movable, and the main terminal treating cover 9 or 9′ also has a radially extending wall or rib 20 or 20′ formed with an opening 19 or 19′ having a diameter sufficiently large so as to allow the movements of the flange portion of the bobbin 1 or 1′ therethrough. Furthermore, the main terminal treating cover 9 or 9′ is also formed at its peripheral side near the rod 6 with a gap 21 or 21′. Similarly, the auxiliary terminal treating cover 10 or 10′ is configured such that when the auxiliary terminal treating cover 10 or 10′ is moved through the opening 17 or 17′ of the main terminal treating cover 9 or 9′ to the position encompassing the outer periphery of the wheel 5 or 5', a spacing is provided between the inner periphery of the cover 9 or 9' and the outer periphery of the cover 10 or 10' for accommodating the terminal portion of the wire-like object.

In this condition, since the entrance spacing 21 and 21' is formed at the extreme, narrow width end of the sloped portion 9*a* or 9*a'*, the entrance spacing 21 or 21' is maintained in its open state so as to permit the travel therethrough of the wire-like object. Within this illustrated embodiment, there is furthermore provided a cutter 14 or 14' mounted upon the outer periphery of the auxiliary terminal end treating cover 10 or 10' at a position near the entrance spacing 21 or 21' of the main terminal treating cover 9 or 9'.

In accordance then with the illustrated embodiment of the present invention as described hereinabove, the terminal portion of the wire-like object 2 is readily inserted through the spacing 21, and under this condition, the terminal portion of the wire-like object is prevented from being caught by the pawl 12 provided upon the bobbin 1 thereby smoothly leading the terminal portion into the spacing defined by the auxiliary cover even when the rod 6 is moved from the position C to the position C' so as to initiate the take-up of the wire-like object upon the empty bobbin. Since the cutter 14 is provided upon the outer periphery of the auxiliary cover 10 at the position near the entrance spacing 21 of the main cover 9, the terminal portion of the wire-like object is initially severed thereby decreasing the length of the terminal portion of the wire-like object that would otherwise move freely due to the centrifugal force impressed thereon until the rotation of the bobbin 1 is terminated. At this instant, an arcuate safety cover 22 also serves to effectively prevent pieces of the terminal portion, which may be severed by means of the cutter, from being dispersed outwardly toward the bobbin 1'.

Within the illustrated embodiment, it should also be noted that the apparatus may further comprise guide plates 23 and 23', each having a slit formed therein so as to permit travel of the terminal portion of the wire-like object therethrough, the severed terminal end being more smoothly conducted toward the sloped portion 9*a* as a result of such structure. The guide plate 23 catches the wire-like object 2 extending between the first grasping position X and the second grasping position Y, whereby the random movement of the terminal end portion, grasped at the point Z by means of the pawl 12' and severed by the cutter, is pervented by means of the guide plate 23 and, therefore, undesirable flutter of the terminal portion of the wire-like object 2 is satisfactorily prevented.

Thus, the severed terminal portion of the wire-like object 2 is immediately directed into the spacing defined by means of the covers 9 and 10 or covers 9' and 10' by means of the sloped portion 9*a*, and consequently, flutter and random movement of the terminal portion of the wire-like object that would otherwise occur after the same has been severed by means of the cutter and grasped by means of the pawl 12' of the empty bobbin 1' is satisfactorily prevented, and therefore, the wire-like object of the full bobbin 1 is prevented from being damaged by the terminal portion of the wire-like object. In addition, as the terminal portion of the wire-like object is grasped by means of the guide plate 23, tension will be impressed upon the wire-like object extending between the guide plate 23 and the take-up point of the bobbin 1 and, accordingly, the wire-like object 2 is more reliably frasped by means of the pawl 12 of the bobbin 1 so as to thereby alleviate failures in the operation.

Figure 25:
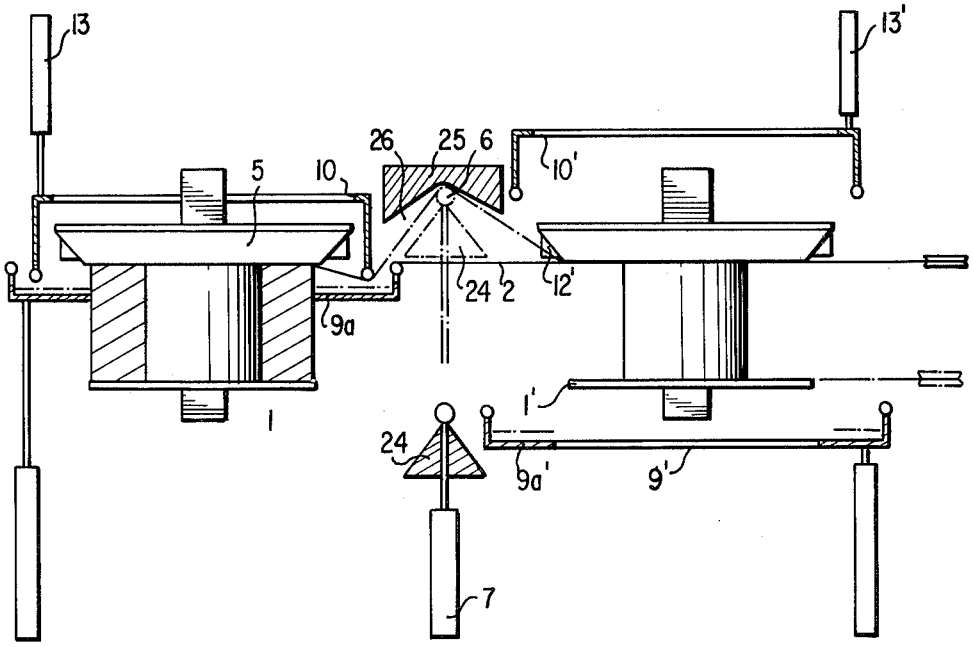
FIG. 25 is a schematic view, partly in cross-section, of a ninth embodiment of the apparatus constructed in accordance with the present invention.

A ninth embodiment of the present invention will now be described in conjunction with FIG. 25 wherein convex and concave shaped guides 24 and 25, respectively, serving as shock absorbing means, are provided within the travel path of the wire-like object 2 between the bobbins 1 and 1' which are disposed in parallel relation with respect to each other. The guide 24 is in the form of a triangular beam, which is connected to the piston rod 6 such that one of the apices thereof assumes a position near the leading end of the rod 6 and is movable therewith. The guide 25 is in turn mounted upon a fixed support means, not shown, and a guide way 26 is thereby defined between the adjacent mating faces of the guides 24 and 25.

In operation, the terminal end of the wire-like object 1 is usually caused to flutter or wave after the same has been severed due to the combined actions of the potential energy stored therein, components of the centrifugal force impressed thereon, and the frictional reactions with other components of the apparatus. However, since the terminal end of the wire-like object 2, in accordance with the present invention, impacts upon the guides 24 and 25, the undesirable actions of the wire-like object 2 are alleviated and the terminal end is satisfactorily guided in the predetermined direction. In this manner, vibration of the terminal end portion of the wire-like object 2 is also alleviated by means of the buffer action of the guides whereby the terminal portion is smoothly guided into the terminal portion accommodating spacing.

As previously noted hereinabove, the present invention has been described with reference to various embodiments which pertain to a method and apparatus for treating the terminal end portion of the wire-like object. Within the method and apparatus for treating the terminal portion of a wire-like object of a take-up machine adapted to lead and guide the terminal end portion of the wire-like object of a full bobbin by cover means, when the wire-like object is adapted to be consecutively and alternately wound upon empty bobbins by pulling the wire-like object extending from the full bobbin toward the empty bobbin and grasping the wire-like object and cutting the same, main and auxiliary terminal treating covers are moved toward each other along the outer periphery of the full bobbin and are caused to overlap each other before the terminal end portion of the wire-like object passes therebetween. In this condition, the terminal portion of the wire-like object is guided through the overlapped portion between the covers and into a terminal accommodating spacing defined between the covers, whereby the terminal portion of the wire-like object is accommodated and treated within the terminal accommodating spacing by means of the centrifugal force impressed thereon.

It should thus be noted that in accordance with the present invention, it is possible to avoid considerable damage to the wire-like object wound upon the full bobbin due to the flutter and random movement of the terminal portion of the wire-like object during a high speed take-up operation and to prevent accidents caused by the severed terminal portion becoming entangled with the moving pawls, the method and apparatus of the present invention thereby improving the yield rate of the product, the take-up efficiency, and providing a safe operation which contributes to the commerical value of the manufacturing system.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. A method for treating the terminal end portion of a wire-like object within a wire-like object take-up apparatus within which, when the wire-like object wound upon a full bobbin is moved toward an empty bobbin and grasped and severed so as to consecutively and alternately perform the take-up operation of the wire-like object upon empty bobbins, the terminal portion of the wire-like object upon the full bobbin being conducted and guided by cover means, comprising the steps of:

moving a main cylindrical terminal treating cover and an auxiliary cylindrical terminal treating cover toward each other along the outer periphery of the full bobbin and relative to the wire-like object being fed to the full bobbin so as to thereby provide an overlapped condition by portions of the main and auxiliary covers for initially guiding and confining said wire-like object within an accommodating spacing defined therebetween prior to the terminal portion of the wire-like object passing therebetween; and actuating a wire-actuating rod, subsequently and independently of said treating covers, for pushing said wire-like object to a position so as to be grasped by a pawl operatively associated with said empty bobbin and be cut by a cutter operatively associated with said full bobbin and for thereby causing said terminal portion of the wire-like object to enter said accomodating spacing defined between the main and auxiliary covers relatively disposed at said overlapped condition, and through an overlapped portion between the main and auxiliary covers, so as the thereby be accommodated and retained within said spacing as a result of centrifugal forces acting thereon during rotation of said full bobbin.

2. A method according to claim 1, wherein:

an axial leading end of the main terminal treating cover is movable toward a flange of said bobbin adjacent a pawl wheel and the travelling wire-like object so as to form a gap therebetween for facilitating the free travelling of said wire-like object.

3. An apparatus for treating the terminal portion of a wire-like object within a wire-like object take-up apparatus within which the wire-like object is moved from a full bobbin to an empty bobbin disposed parallel thereto for thereby performing a continuous take-up operation, comprising in combination:

an auxiliary cylindrical terminal treating cover disposed upon a pawl wheel side of said bobbin and which is movable along the axis of rotation of the bobbin, said auxiliary cylindrical terminal treating cover being larger in diameter than the outer periphery of said bobbin;

a main cylindrical terminal treating cover disposed opposite said auxiliary terminal treating cover and movable along the axis of rotation of said bobbin so as to form a terminal accommodating spacing around the outer periphery of said bobbin between said auxiliary terminal treating cover and said main terminal treating cover;

first actuating means for actuating said auxiliary terminal treating cover;

second actuating means for actuating said main terminal treating cover;

a wire-actuating rod for pushing said wire-like object to a position so as to be grasped by a pawl provided upon the periphery of said bobbin; and third actuating means for actuating said wire-pushing rod.

4. An apparatus according to claim 3, further comprising:

guide means having an outer peripheral wall formed in an arcuate shape and fixedly mounted upon at least one of the peripheries of said main and auxiliary terminal treating covers.

5. An apparatus according to claim 4, wherein:

said guide means is disposed within said terminal accommodating spacing and the center of said arcuate shape is concentric with the axis of rotation of said bobbin, said guide means having its outer peripheral wall inclined relative to said axis of rotation of said bobbin.

6. An apparatus according to claim 4, wherein:

said guide means is disposed within said terminal accommodating spacing and the center of said arcuate shape is eccentric with respect to said axis of rotation of said bobbin.

7. An apparatus according to claim 4, wherein:

said guide means extends from the radially outer portion of said terminal accommodating spacing to the radially inner portion thereof, and the center of said arcuate shape is eccentric with respect to the axis of rotation of said bobbin.

8. An apparatus according to claim 3, wherein:

said wire-pushing rod and said third actuating means are fixedly mounted upon said main terminal treating cover.

9. An apparatus according to claim 3, further comprising:

a biasing ring secured to said wire-pushing rod.

10. An apparatus according to claim 3, further comprising:

a shock absorbing guide disposed along the travelling path of said terminal portion of said wire-like object and between said full bobbin and said empty bobbin which are disposed parallel to each other.

11. An apparatus according to claim 3, wherein:

a sloped portion is formed upon at least one of the outer peripheral walls of said main and auxiliary terminal treating covers for guiding said terminal portion of said wire-like object.

12. An apparatus according to claim 11, wherein:

a guide plate is fixedly mounted upon the outer peripheral wall of said auxiliary terminal treating cover and has a slit formed therein so as to permit travel of said terminal portion of said wire-like object therethrough.

13. An apparatus according to claim 3, wherein:

a cutter is secured upon the outer peripheral wall of said auxiliary terminal treating cover.

14. An apparatus according to claim 3, wherein:

a cutter is mounted upon said wire-pushing rod.

15. An apparatus according to claim 3, wherein:

a safety cover is secured to said wire-pushing rod.

* * * * *